United States Patent [19]

Dunfield

[11] Patent Number: 4,538,930

[45] Date of Patent: Sep. 3, 1985

[54] ADAPTIVE PRINT HAMMER DAMPER

[75] Inventor: John C. Dunfield, San Jose, Calif.

[73] Assignee: Xerox Corporation, Stamford, Conn.

[21] Appl. No.: 653,260

[22] Filed: Sep. 24, 1984

[51] Int. Cl.[3] ..... B41J 9/42

[52] U.S. Cl. ..... 400/144.2; 101/93.02; 400/157.2; 400/167; 361/152

[58] Field of Search ..... 101/93.02, 93.29; 400/157.2, 167, 144.2; 361/152-154

[56] References Cited

U.S. PATENT DOCUMENTS 4,192,230 3/1980 Blom et al. ..... 101/93.29 X 4,429,342 1/1984 Heider ..... 101/93.29 X

*Primary Examiner*—Paul T. Sewell

*Attorney, Agent, or Firm*—Robert E. Cunha

[57] ABSTRACT

A circuit for controlling the hammer velocity of an impact printer is described. A velocity sensor generates a signal which is a function of hammer position. This is compared to a reference voltage, and a drive pulse is generated if a velocity correction is needed. The sensor can be located at the backstop and used to control the hammer velocity toward zero as the position nears the backstop. If the sensor is located at the backstop, the sensor output will remain constant for following velocity as its position approaches the backstop, allowing a constant reference voltage. A table look-up can be inserted in the circuit to supply corrections, for a sensor that does not have a position dependent velocity output.

2 Claims, 8 Drawing Figures

ADAPTIVE PRINT HAMMER DAMPER

This invention is a circuit for damping a print hammer on its return path to the backstop, and specifically describes a velocity sensor for use in the circuit for outputting a voltage which increases as a function of both hammer velocity and proximity to the backstop, so that the sensor output, when compared to a fixed threshold, will directly provide a binary indication of whether a damping pulse is required.

BACKGROUND OF THE INVENTION

In an impact printer of the type in which a hammer impacts the character to be printed, there is typically a drive coil for driving the hammer into the character and paper, and a spring for returning the hammer to the backstop. The return velocity will be high immediately after impact, and the hammer will continue toward the backstop because of the spring bias, but it will slow down as it travels toward the backstop because of friction and windage losses. The maximum printing speed is limited by the time required for the hammer to return to rest at the backstop. If the hammer still has any residual energy, in the form of a velocity in either direction, or in the form of a position anywhere other than in contact with the backstop, the energy applied to the next character will be added to the residual energy in the hammer, resulting in a hammer impact which is too large or small. Of course, this results in a loss of print quality. If the hammer velocity could be brought smoothly to zero at the backstop, there would also be a reduction in the noise level, which would make the printer less objectionable in an office environment.

Various methods can be used to control the return velocity to bring it to zero at the backstop. For instance, a velocity or position sensor can be used to measure or calculate the position and velocity of the hammer, and an analog servo system can be used to control the velocity. However, the cost of such a system probably would be excessive for a small, commercial printer.

Another method would be to apply a drive pulse of predetermined timing and duration during the return of the hammer to result in zero velocity as the hammer just reaches the backstop. Since large letters like M and W require a greater velocity to achieve a greater printing force, and since the coefficient of restitution is close to one at the impact point, there are a number of likely return velocities, each having its own damping pulse parameters. The problem with this system is that the predetermined pulse parameters can only be determined for an average case, and cannot take into accound variations in manufacturing tolerances, temperature effects, effects of wear on the mechanical components, etc.

SUMMARY OF THE INVENTION

What is needed is a low cost system for calculating the duration of the damping pulse based on the actual measured velocity. This invention accomplishes this objective by providing a hammer velocity sensor which is stationary and located at the backstop and which, therefore, is sensitive not only to the hammer velocity, but also to the hammer position in relation to the backstop. At a constant velocity, the sensor output would increase as the hammer approaches the backstop. Since it is intended that the actual velocity should decrease as the hammer approaches the backstop, then the effect of the decreased velocity will be offset by the effect of closer coupling between the hammer and the sensor. If the sensor and hammer structures are designed properly, the sensor will put out a constant voltage as the velocity approaches zero and as the position approaches the backstop. In effect, the sensor calculates whether the instantaneous velocity is above or below the velocity profile. The sensor output then is merely compared in an analog comparator to a threshold, and the binary output thus produced is used to generate a damping pulse when the threshold is exceeded.

In the case where the output of the sensor cannot be perfectly matched to the velocity profile, corrections can be added by providing a processor to generate a digital representation of the sensor output expected at known points in time after hammer impact, and a digital-to-analog converter for supplying an analog voltage to the comparator. In this case, the sensor need not be located at the backstop, and the circuit will operate in the forward and backward directions. The additional cost of this embodiment is not likely to be significant since a processor probably is already built in to the system for controlling other printer functions.

BRIEF DESCRIPTION OF THE DRAWINGS

This invention will be described in relation to the following drawings.

DETAILED DESCRIPTION OF THE DRAWINGS

Figure 1A:
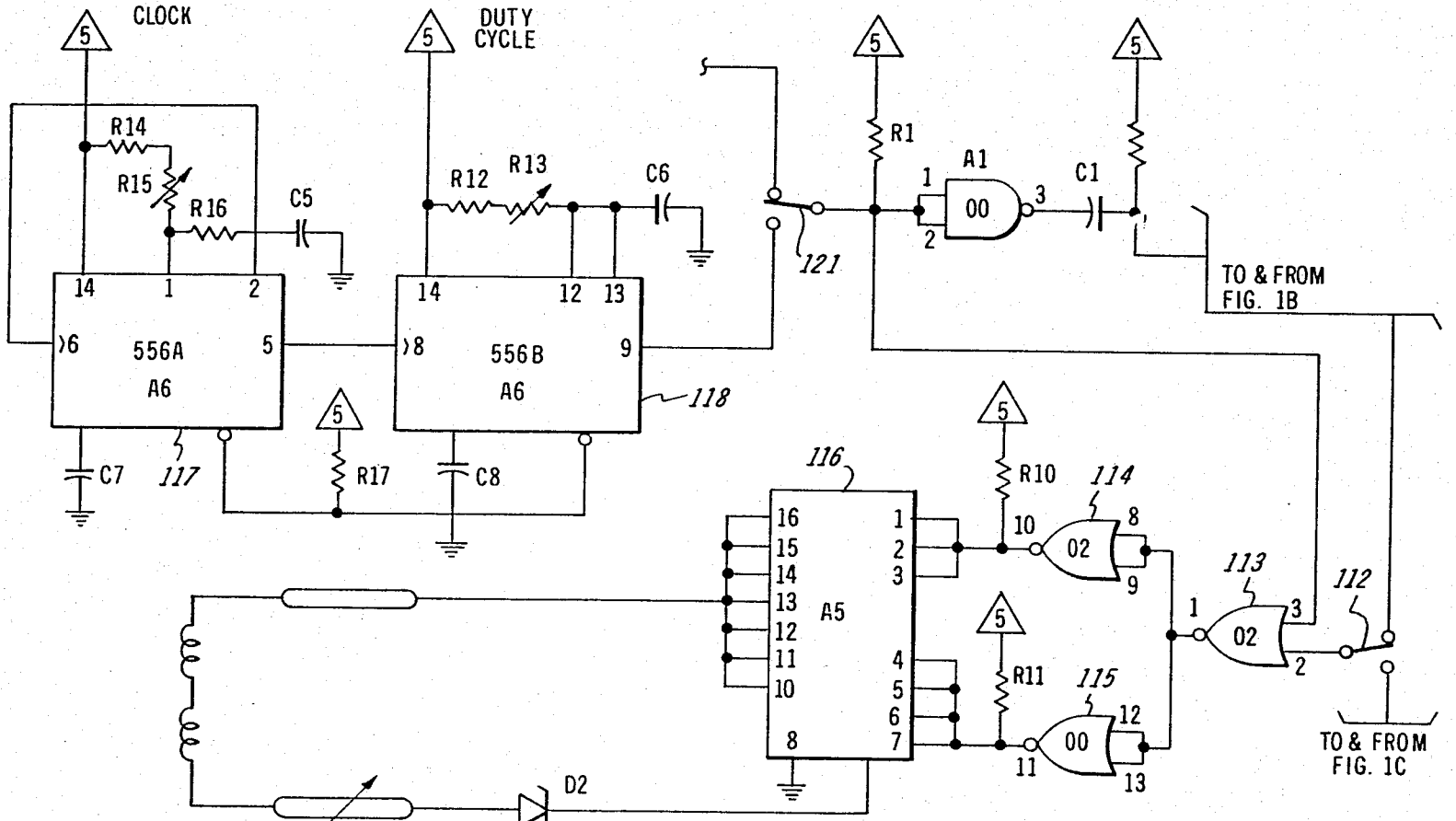
FIGS. 1A–1F are a schematic diagram of a circuit for producing drive pulses from the sensor output and for testing the effectiveness of the circuit.
Figure 1B:
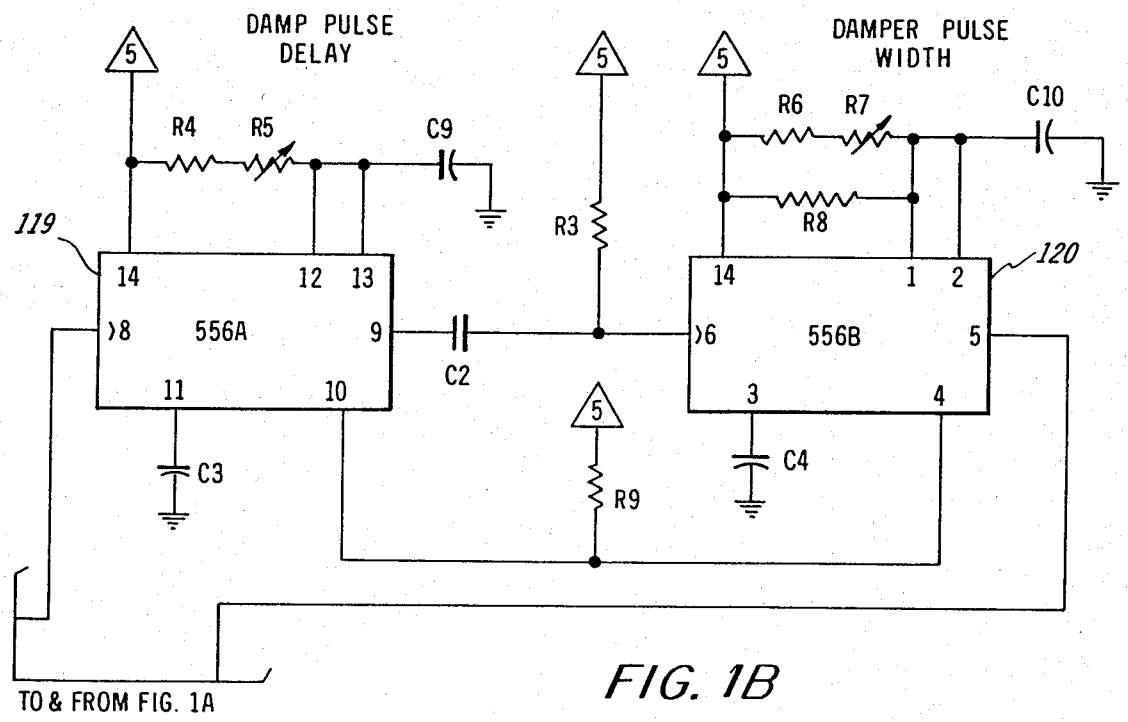
Figure 1C:
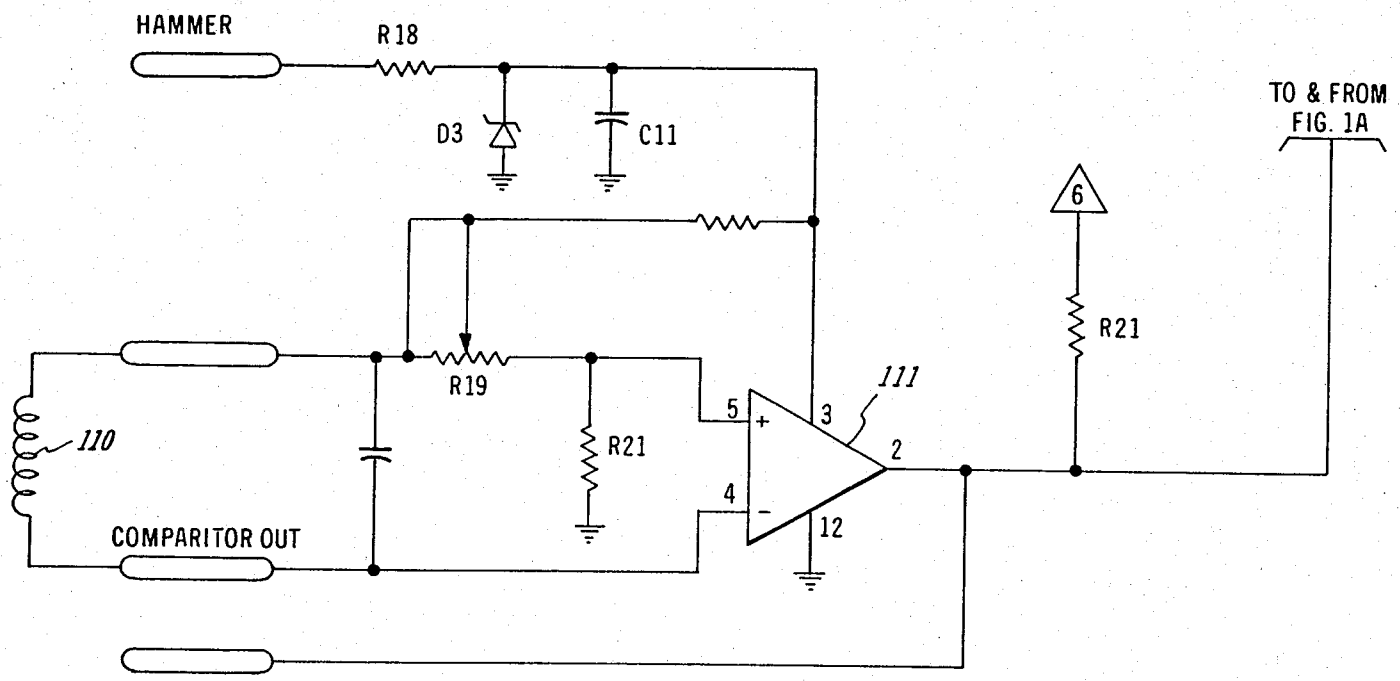
Figure 1D:
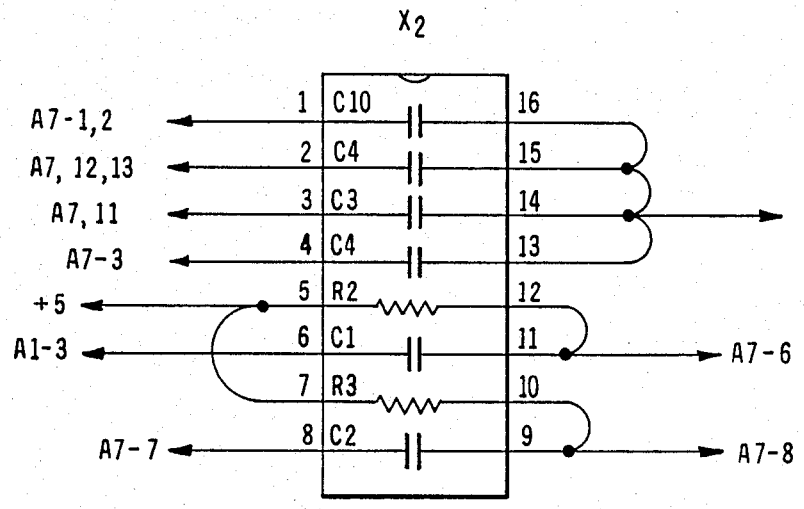
Figure 1E:
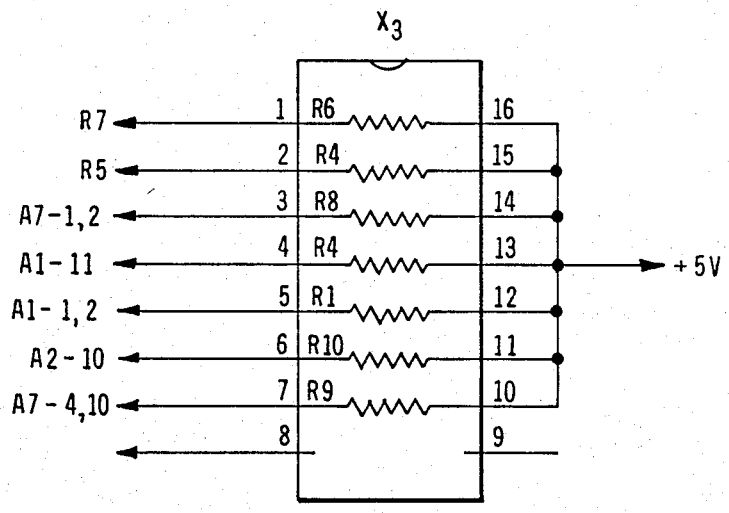
Figure 1F:
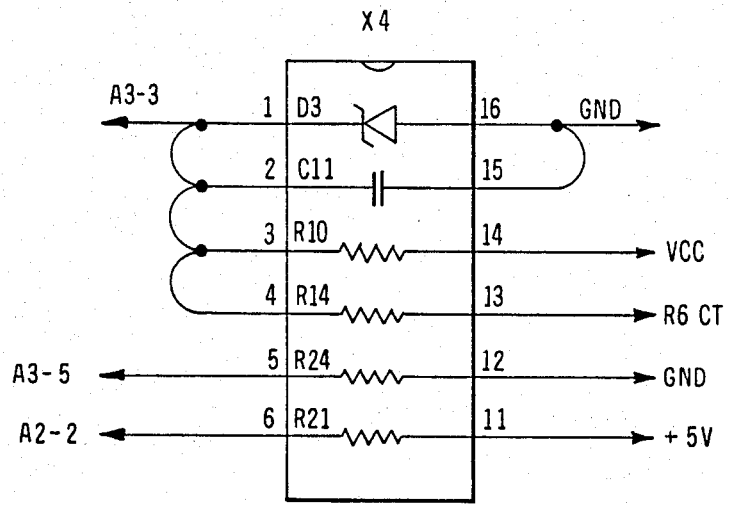

In FIG. 1C, the sensor coil 110, which in this described example is 1200 turns of number 40 wire, picks up the flux rate of change and applies it as a voltage to amplifier 111, which is implemented as an adjustable comparator. R19 is the adjustable resistance. This output, which is a binary high or low, is coupled through switch 112 to gates 113, 114 and 115, which, in turn, supply an input to power driver 116. The outputs are tied together and supply the drive pulse to the hammer coil, which comprises two sets of windings, each having 653 turns of number 30 wire.

To test this circuit against a damping pulse of fixed duration, the remainder of the circuit was fabricated. Flip-flop 117 is adjustable by R15 to set a basic clock rate, and drives adjustable flip-flop 118 which determines the duty cycle, or duration, of the drive pulse. This is send to the hammer driver 116 and is used as the main pulse for driving the hammer against the character.

Flip-flop 119 receives a clock through switch 121 from either the system or from the test circuit to generate a damping pulse. If the system clock is used, the clock is the same one that was used to generate the hammer pulse. Otherwise, the output of flip-flop 118 is used. In either case, flip-flop 119 is set to a delay equal to the time it takes for the hammer to partially return to the backstop. At the end of the delay, flip-flop 120 generates a pulse which is supplied to the drive coil to damp the hammer return velocity. The adjustments to flip-flops 119 and 120 are tuned to produce the best damping for a given drive impulse. This performance is then compared to the operation of the adaptive damping produced from the sensor 110, so that the efficiency of the two circuits can be compared. The comparison is made by throwing switch 112 between the adaptive and fixed pulse circuits.

Figure 2:
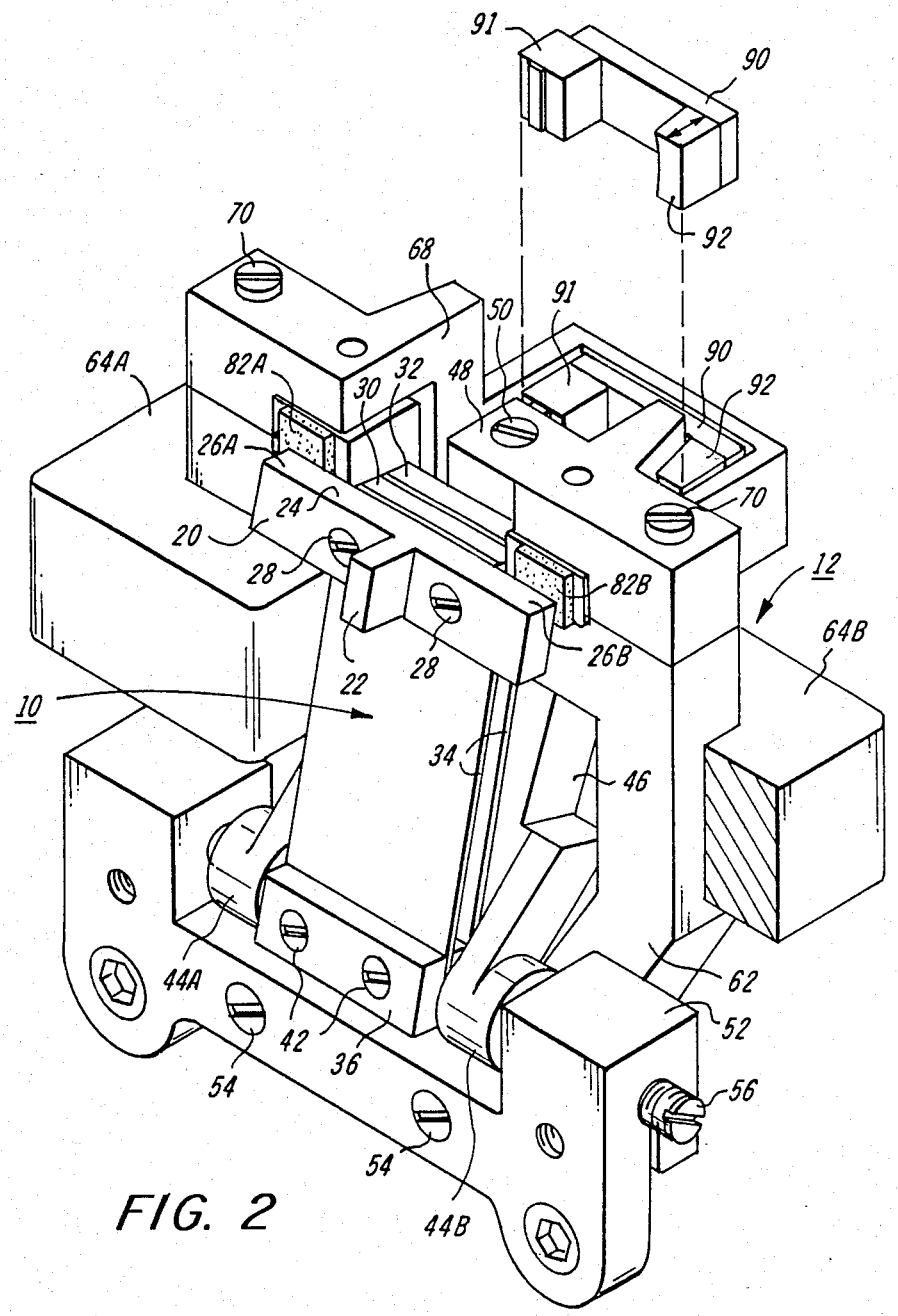
FIG. 2 is a drawing of the sensor and the hammer in a typical printer.

FIG. 2 is a detailed mechanical drawing of the sensor.

The hammer assembly 10 shown in FIG. 2 includes a hammer mass 20. The mass comprises an impact nose 22 extending outwardly from transverse plate 24, having outrigger ends 26A and 26B, secured, as by means of suitable fasteners 28, to spacer block 30 and end block 32. The nose is the portion of the hammer which is driven into contact with a character on the printwheel during printing. Travel of the mass is effected by swinging it about a pivot axis upon a moment arm defined by a pair of generally parallel, planar leaf springs 34 sandwiched and retained between plate 24 and blocks 30 and 32. Opposite ends of springs 34 are mounted by being sandwiched between bottom blocks 36 secured, together by fasteners 42. The rear bottom block, not shown, is integral with pivot bosses 44A and 44B, defining the pivot axis, and support arm 46 upon which is secured a magnetically soft plunger mass 48, as by fasteners 50. The support arm is made of a nonmagnetic material so as not to be affected by the flux field of the electromagnetic actuator into which the plunger mass is drawn. If desired, the plunger mass 48 may be made of a ferromagnetic material having a polarity in the same direction as that induced in the electromagnetic actuator, in order to obtain a greater driving force.

The pivotable hammer assembly 10 is mounted relative to the electromagnetic drive actuator 12 upon a pivot support member 52. secured to the electromagnetic drive actuator by fasteners 54. Pivot screws 56 with reduced diameter pivot pin extensions (not shown) are threadedly received in tapped openings in pivot support member 52. The pivot pin extensions are received in axial openings of pivot bosses 44A and 44B for allowing the print hammer assembly 10 to rotate freely thereabout.

The electromagnetic drive actuator 12 comprises a C-shaped yoke having a pair of legs 62 each supporting an electrically conductive coil 64A and 64B wired together in series. Although a pair of coils is illustrated, only a single one is necessary as long as the number of turns of wire is sufficient. It is understood, however, that a single large coil will require more space, more wire and more power. The open end of the yoke has parallel facing surfaces which are spaced apart sufficiently for the plunger mass 48 to freely pass therebetween with only a small gap between each side of the plunger and its respective pole piece.

A plunger backstop 68 is secured by fasteners 70. The backstop is fabricated of a nonmagnetic material, such as aluminum or plastic, in order not to create a magnetic short circuit field when the electromagnet is energized. Secured to the backstop 68, as by a suitable adhesive material, are resilient, plunger damper pads 82A and 82B preferably made of an energy absorbing rubber or like material, such as Isodamp C-1002 manufactured by EAR Corporation of Indianapolis, Ind. It is important that the material selected does not retain a set and that its surface does not become tacky. The thickness of the damper pads must be such that the surface which faces the hammer mass 20 is accurately positioned at the "home" position of the plunger mass. This will insure that the plunger mass will always start its travel at the same location and will be acted upon by the electromagnetic actuator 12 so that a predictable amount of energy is introduced into the hammer assembly 10.

The sensor comprises an iron "L" shaped bracket 90 on the end of which the sensor coil 91 is wound. On the other end of the bracket 90 is a permanent magnet 92 having a field in the direction shown by the arrows. As the plunger mass 48 returns to backstop 68, there will be an increased magnetic linkage and an increase of lines of flux, generating a voltage at coil 91.

The sensor is shown as being located at the top of the hammer assembly 10. However, in the case where mechanical vibrations are set up in the springs 34 as a result of drive and impact forces, the sensor output may be affected. It may therefore by advantageous in some cases to locate the sensor closer to the bottom of the hammer assembly 10, closer to the pivot bosses 44A and 44B where the effect of these mechanical transients will be minimum.

Figure 3:
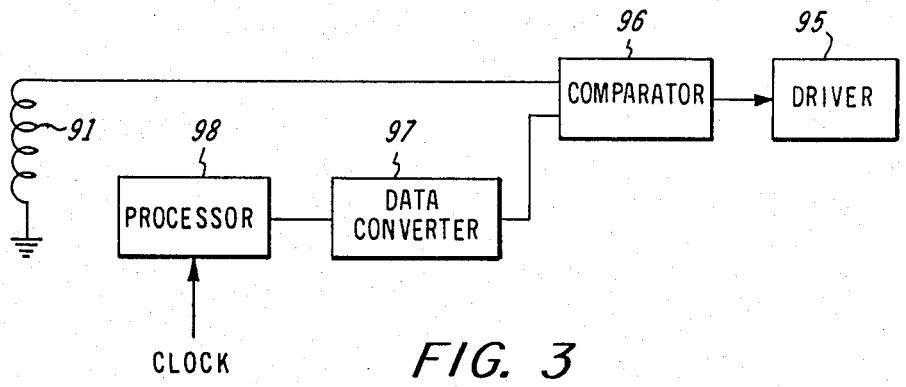
FIG. 3 is a block diagram of an alternate embodiment which uses a processor and a D to A converter to generate a variable reference voltage.

In the case where the sensor output is not a perfect match to the desired velocity profile, a processor can be used to supply corrections. This embodiment is shown in FIG. 3. The sensor pick-up coil 91 produces an analog output voltage which may be any known function of the hammer velocity and position. At the same time the processor 98, either by calculation or table look-up, determines what the velocity of the hammer at that point in time should be, and outputs a digital representation. This is converted in D to A converter 97 and is compared at comparator 96, the binary output of which is coupled to the driver to generate a drive pulse.

In the alternative, the circuit may be configured to reduce the velocity to zero at some point other than at the backstop, or to reduce the velocity to a certain value other than zero at the backstop, depending on individual system requirements. The described circuit can be tuned for any of these requirements. In addition, this concept can be used to drive the hammer in a forward, as well as a backward, direction.

While the invention has been described with reference to specific embodiments, it will be understood by those skilled in the art that various changes will be made and equivalents may be substituted for elements thereof without departing from the true spirit and scope of the invention. In addition, many modifications may be made without departing from the essential teachings of the invention.

What is claimed is:

1. In an impact printer, a hammer assembly comprising a hammer, a drive coil for driving the hammer against the printing element, and biasing means for returning the hammer to a backstop, a circuit for reducing the hammer velocity as the hammer position approaches the backstop, comprising:

a sensor responsive to the velocity of said hammer during said hammer's return to the backstop for producing an output which increases as a function of increased hammer velocity and increases as a function of decreased distance between the hammer and the backstop, said sensor comprising a magnet, a core and a pickup coil, the magnet inducing lines of flux into said core, the core being made up of a fixed portion and a moveable portion, the portions being mechanically coupled to the hammer so that motion of the hammer results in a voltage output at the pick-up coil, said core being arranged so that the output voltage will be greatest for a given change of position when the hammer is closest to the backstop, a comparator means responsive to the output of said sensor means for comparing said output to a threshold voltage, and for producing a binary signal whenever the hammer velocity exceed the predetermined velocity, and a driver responsive to said binary signal for generating a drive pulse and applying it to said drive coil in a forward direction to reduce the hammer velocity smoothly to zero as the hammer approaches the backstop, to increase print quality and decrease noise levels.

2. The assembly of claim 1 wherein said comparator means compares the sensor output to a constant reference voltage.

* * * * *